US008893805B2

(12) United States Patent
McGarian

(10) Patent No.: US 8,893,805 B2
(45) Date of Patent: Nov. 25, 2014

(54) BYPASS VALVE FOR USE IN WELL BORES

(76) Inventor: Bruce McGarian, Stonehaven (GB)

( * ) Notice: Subject to any disclaimer, the term of this patent is extended or adjusted under 35 U.S.C. 154(b) by 1383 days.

(21) Appl. No.: 12/526,497

(22) PCT Filed: Jan. 17, 2008

(86) PCT No.: PCT/GB2008/000155

§ 371 (c)(1),
(2), (4) Date: Apr. 12, 2010

(87) PCT Pub. No.: WO2008/107628

PCT Pub. Date: Sep. 12, 2008

(65) Prior Publication Data

US 2010/0193196 A1 Aug. 5, 2010

(30) Foreign Application Priority Data

Mar. 2, 2007 (GB) ..... 0704111.4
Mar. 5, 2007 (GB) ..... 0704218.7

(51) Int. Cl.
*E21B 34/10* (2006.01)

(52) U.S. Cl.
USPC ..... 166/374; 166/332.2; 166/319; 166/331; 175/317; 137/118.04; 137/115.08; 251/230

(58) Field of Classification Search
USPC ..... 166/331, 332.2, 386, 374, 319; 175/317; 137/118.04, 115.08; 251/230
See application file for complete search history.

(56) References Cited

U.S. PATENT DOCUMENTS

| | | | | |
|---|---|---|---|---|
| 4,293,038 | A * | 10/1981 | Evans | 166/331 |
| 5,901,796 | A * | 5/1999 | McDonald | 175/57 |
| 6,634,424 | B2 * | 10/2003 | Knowles | 166/237 |
| 2004/0129423 | A1 * | 7/2004 | Eddison | 166/321 |

FOREIGN PATENT DOCUMENTS

| | | | |
|---|---|---|---|
| GB | 2366311 | A * | 3/2002 |
| WO | WO 2004097165 | A1 * | 11/2004 |

* cited by examiner

*Primary Examiner* — Robert E Fuller
(74) *Attorney, Agent, or Firm* — Hancock Hughey LLP

(57) ABSTRACT

Bypass valve comprising a ported housing (1) and concentrical ported sleeve (2). Ported piston (3) is slidably arranged within the sleeve. Between sleeve and piston is a control system consisting of control element (5) fixed to sleeve (2) by means of plugs (7) passing through apertures (49) and holes (68). Noses (35) protrude into recesses (34) of drive element (4). Saw teeth (31) on drive element (4) interact with teeth (29) on rotatable timing element (6). Key (27) on element (6) interacts with teeth (32) on control element (5). Lower end (70) of key is abutting against ridge (67) formed on inner surface of sleeve (2). when key (27) is engaged to teeth (32), teeth (31, 29) on elements (4, 6) are misaligned. Pressure increase results in piston (3) and drive element (4) moving downward freeing key (27) from engagement with teeth (32). Teeth (31, 29) are forced into alignment with subsequent rotation of timing element (6). In this position, ports on piston and sleeve are partially aligned. Pressure decrease results in element (6) moving up key (27) moving to next notch of teeth (32). When key (29) coincides with slot (50), piston (3) moves further down, partially occluding piston ports. When key (27) coincides with slot (52) piston (3) moves even further down totally occluding piston ports.

20 Claims, 11 Drawing Sheets

38
4
34
5
7
31
29
6
30
3
44
32
45
27
19

31
29
45
32
69

31
29
45
72

31
29
70
30
44

BYPASS VALVE FOR USE IN WELL BORES

FIELD OF THE INVENTION

THIS INVENTION relates to a valve, and in particular concerns a bypass valve for use in well bores, during drilling, exploration and the like.

BACKGROUND AND DESCRIPTION OF RELATED ART

Conventional drilling techniques utilise down-hole drill bits which are conveyed on lengths of drill pipe, which may be rotated from the surface to turn the drill hits, or alternatively a down-hole positive displacement motor may be used to produce the necessary rotary cutting action.

Debris and cuttings are produced in these processes, and this debris is circulated and transported to the surface by the drilling mud or well bore fluid. This fluid is typically pumped from the surface along the centre of the drill pipe, and exits the drill pipe near the milling head into the annulus (i.e. the region within the well bore but external to the drill pipe itself). It will be appreciated that a relatively high pressure is required to maintain this circulation.

It may also be necessary to monitor the axial position and angular orientation of a tool, such as a whipstock, within a well bore, and this is most commonly achieved using a measurement-while-drilling (MWD) tool. A MWD tool requires, however, a relatively high-pressure flow of fluid through the drill pipe to operate.

In many circumstances, a drill string terminates in a hydraulically-set packer, which expands when it is set to press tightly against the inner surface of the bore, thus providing a secure anchoring point for other components further up in the bore. For instance, one or more shear bolts or wires may be broken to activate the packer, or the packer may be activated by inflation.

Hydraulically-set packers are activated automatically when the pressure of fluid at the packer reaches a certain level. If, therefore, large quantities of well fluid are circulated into the drill pipe, as discussed above, the hydraulic packer may accidentally be set prematurely. A bypass valve is therefore required to allow the well fluid to be circulated to the annulus relatively freely before it is desired to set the packer, but to divert well fluid to the packer under high pressure when the packer is to be set.

Alternatively, packers can be set with setting tools, and it has also previously been proposed to use a "drop-ball" system, in which a ball is dropped down the drill pipe to activate a switch, which diverts the well fluid to the packer. These drop-ball systems suffer from certain disadvantages, however, since there is a limit to the number of balls that can be dropped, or in some systems a bore cuts off circulation to the main bore once it has landed on its seat. In addition, it is usually not possible for the ball to pass through a MWD tool, and therefore valves using a drop-ball system can generally only be used higher up in the drill string than an MWD tool. This is undesirable, since the fluid that passes through the MWD tool is preferably circulated to the annulus through the valve, and therefore ideally the valve is placed downstream of the MWD tool.

Other bypass valves utilise indexing tracks, in which a piston moves within a housing, but one or more protrusions on the external surface of the piston follow guide tracks formed on the inside of a housing. A first section of the guide track may be a "zig-zag" shape, so that the piston may be driven up and down a limited distance with respect to the housing and the piston will rotate as it follows the zig-zag track, and during this motion respective apertures formed in the piston and housing are at least partially aligned to allow well fluid to circulate to the annulus. At a certain point in the track, however, the track allows the piston to travel further downwards with respect to the housing, by means of a section of track which extends downward below the main zig-zag pattern, to a position in which the apertures do not align and circulation to the annulus is prevented. Such a system is disclosed, for example, in WO97/21020.

Such systems suffer from disadvantages, however, in that the piston is required to rotate axially within the housing in order to follow the indexing track, and this results in a frictional component from the seals of the valve, which resist this rotational movement, leading to undesirable wear and tear.

SUMMARY OF THE INVENTION

It is an object of the present invention to provide a bypass valve which ameliorates some or all of the above problems.

Accordingly, one aspect of the present invention provides a valve comprising: a housing having an outer wall, the outer wall having at least one outlet formed therethrough; a piston disposed within the outer wall, the piston having a fluid channel formed in an interior thereof; and a control arrangement comprising a rotating element which is rotatable with respect to the housing and the piston and a driving member which is adapted to drive against the rotatable element, the arrangement being such that: in a first rotational orientation of the rotating element, the piston and housing may be driven with respect to one another in a first direction so that the driving member moves with respect to the rotatable element and contacts the rotatable element to exert a force against the rotatable element which tends to drive the rotatable element in a direction substantially parallel with the first direction, and relative motion between the piston and the housing is halted by the rotating element contacting a stop element, during which motion the piston remains in a first position or range of positions relative to the housing; and in a second rotational orientation of the rotating element, the piston and housing may be driven with respect to one another so that the piston reaches a second position relative to the housing.

Advantageously, the housing has at least one outlet formed through the outer wall, and the piston has at least one port allowing communication between the fluid channel and an exterior of the piston, the piston and housing being slidably movable relative to each other to allow the first position or range of positions of the piston relative to the housing, in which the at least one port is in communication with the at least one outlet of the outer wall, allowing fluid to flow from the fluid channel through the at least one outlet, and the second position of the piston relative to the housing, in which the at least one port is not in communication with the at least one outlet of the outer wall and fluid is prevented from flowing from the fluid channel through the at least one outlet.

Alternatively, the housing has at least one outlet formed through the outer wall, and the piston has at least one port allowing communication between the fluid channel and an exterior of the piston, the piston and housing being slidably movable relative to each other to allow the first position or range of positions of the piston relative to the housing, in which at least one port is not in communication with the at least one outlet of the outer wall and fluid is prevented from flowing from the fluid channel through the at least one outlet, and the second position of the piston relative to the housing, in which the at least one port is in communication with the at least one outlet of the outer wall, allowing fluid to flow from the fluid channel through the at least one outlet.

Preferably, in the first position or range of positions of the piston relative to the housing, the piston remains substantially within the housing, and in the second position of the piston relative to the housing, a lower end of the piston, or a further element driven by the motion of the piston, protrudes out of the housing.

Conveniently, the rotating member at least partially surrounds the piston.

Advantageously, at least one of the rotatable element and the driving member is axially slidable with respect to the piston.

Preferably, the driving member is integral with, or fixed to, the piston.

Conveniently, the driving member and timing element are provided with respective inclined engaging surfaces, so that the driving element exerts a rotational force on the timing element when the driving member exerts a force against the rotatable element which tends to drive the rotatable element in a direction substantially parallel with the first direction.

Advantageously, the rotating element has a key protruding from a surface thereof, which contacts the stop element when the piston and housing are driven with respect to each other and the rotating element is in the first rotational orientation thereof.

Preferably, the valve further comprises a control element having a number of recesses, each of the recesses being shaped to receive the key, a plurality of respective rotational orientations of the rotating member being defined by the key being received in each of the recesses.

Conveniently, the control element does not rotate with respect to the piston.

Advantageously, the stop element is formed on an inner surface of the housing, or of an inner member which at least partially surrounds the piston, the arrangement being such that, when the piston and housing are driven with respect to each other and the rotating element is in the first rotational orientation thereof, the key is aligned with the stop element, and when the piston and housing are driven with respect to one another and the rotating element is in the second rotational orientation thereof, the key is not aligned with the stop element.

Preferably, the stop element comprises a surface provided on the housing or the inner member, a control slot being formed which provides a break in the surface, and wherein the piston and housing are driven with respect to one another and the rotating element is in the second rotational orientation thereof, the key is aligned with the control slot.

Conveniently, a further control slot is formed providing a break in the surface forming the stop element, wherein when the piston and housing are driven with respect to one another and the rotating element is aligned with the further control slot, the piston may be driven into a partial flow position which is within the first range, of positions but in which the at least one port of the piston in partially occluded.

Advantageously, when the piston is in the partial flow position and the piston ceases being driven with respect to the housing, the rotating element moves into the second rotational orientation thereof.

Preferably, the rotating member is biased into a rest position by one or more springs.

Conveniently, the valve comprises a viewing aperture in the housing which may be opened so that a current rotational orientation of the rotating member may be viewed.

Advantageously, indicia are presented on an outer surface of the rotating element to allow a user to determine visually the rotational orientation thereof.

Preferably, the piston and the housing may be driven with respect to one another by an increase in the flow rate of fluid passing through the valve.

Advantageously, when the rotating member is in the first rotational orientation thereof and the piston is driven relative to the housing, the rotating element moves to a different rotational orientation.

Conveniently, when the rotating member is in the first rotational orientation thereof, the piston may be driven relative to the housing so that the rotating element moves to the second rotational position thereof.

Another aspect of the present invention provides a method of providing pressurised fluid to a component, comprising the steps of: providing a valve according to any preceding claim; positioning the component downstream of the valve, so that a fluid may flow through the valve and then to the component when the piston is in the second position relative to the housing; placing the rotational member of the valve in the first rotational orientation thereof; allowing fluid to flow through the valve; increasing the rate of flow of the fluid so that the timing element moves to the second rotational position; and increasing the rate of flow of the fluid so that the piston moves to the second position relative to the housing.

Advantageously, the component is a hydraulically-set packer.

A further aspect of the present invention provides a method of controlling a component, comprising the steps of: providing a valve according to any preceding claim; positioning the component downstream of the valve so that the piston, or another element driven by the motion of the piston, may contact the component when the piston is in the second position relative to the housing; placing the rotational member of the valve in the first rotational orientation thereof; allowing fluid to flow through or to the valve; increasing the rate of flow or quantity of the fluid to the valve so that the timing element moves to the second rotational position; and increasing the rate of flow or quantity of the fluid to the valve so that the piston moves to the second position relative to the housing.

BRIEF DESCRIPTION OF THE DRAWINGS

In order that the present invention may be more readily understood, embodiments thereof will now be described, by way of example, with reference to the accompanying drawings, in which.

DETAILED DESCRIPTION OF PREFERRED EMBODIMENTS OF THE INVENTION

Figure 1:
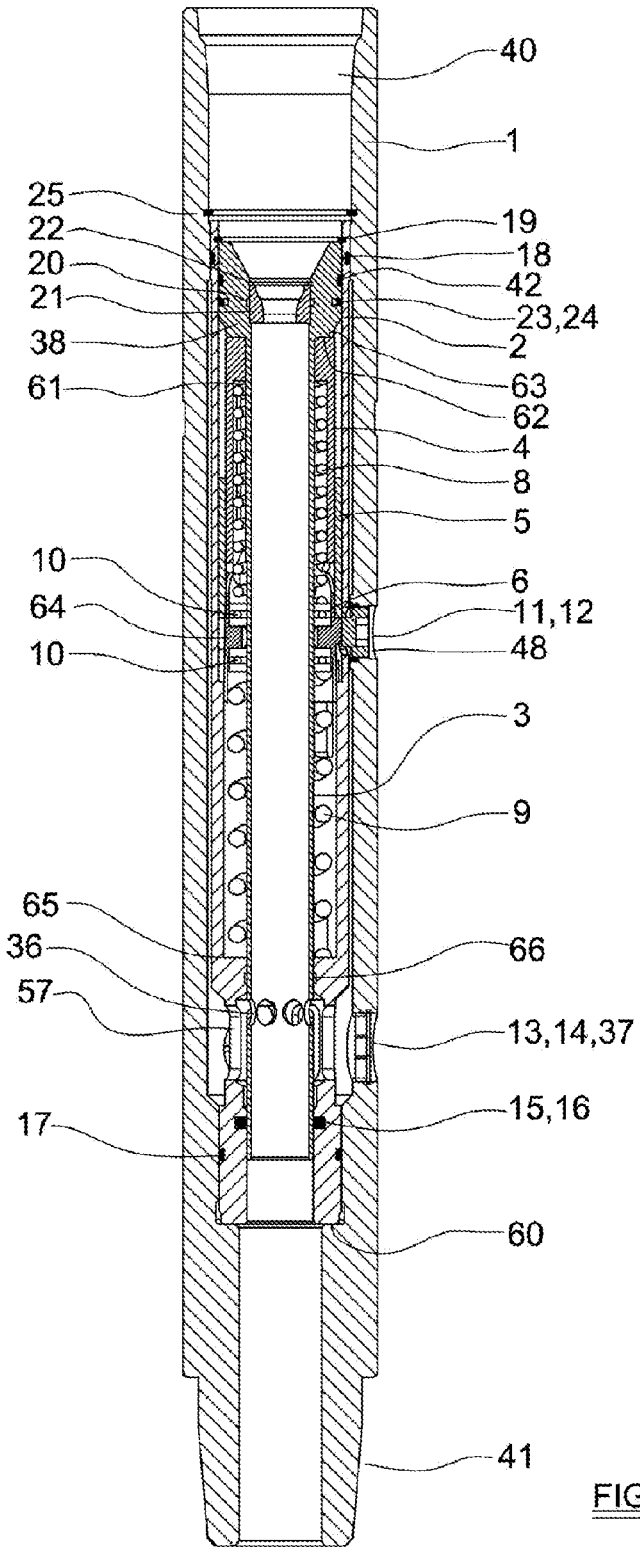
FIG. 1 is a cut-away view of a bypass valve embodying the present invention.
Figure 2:
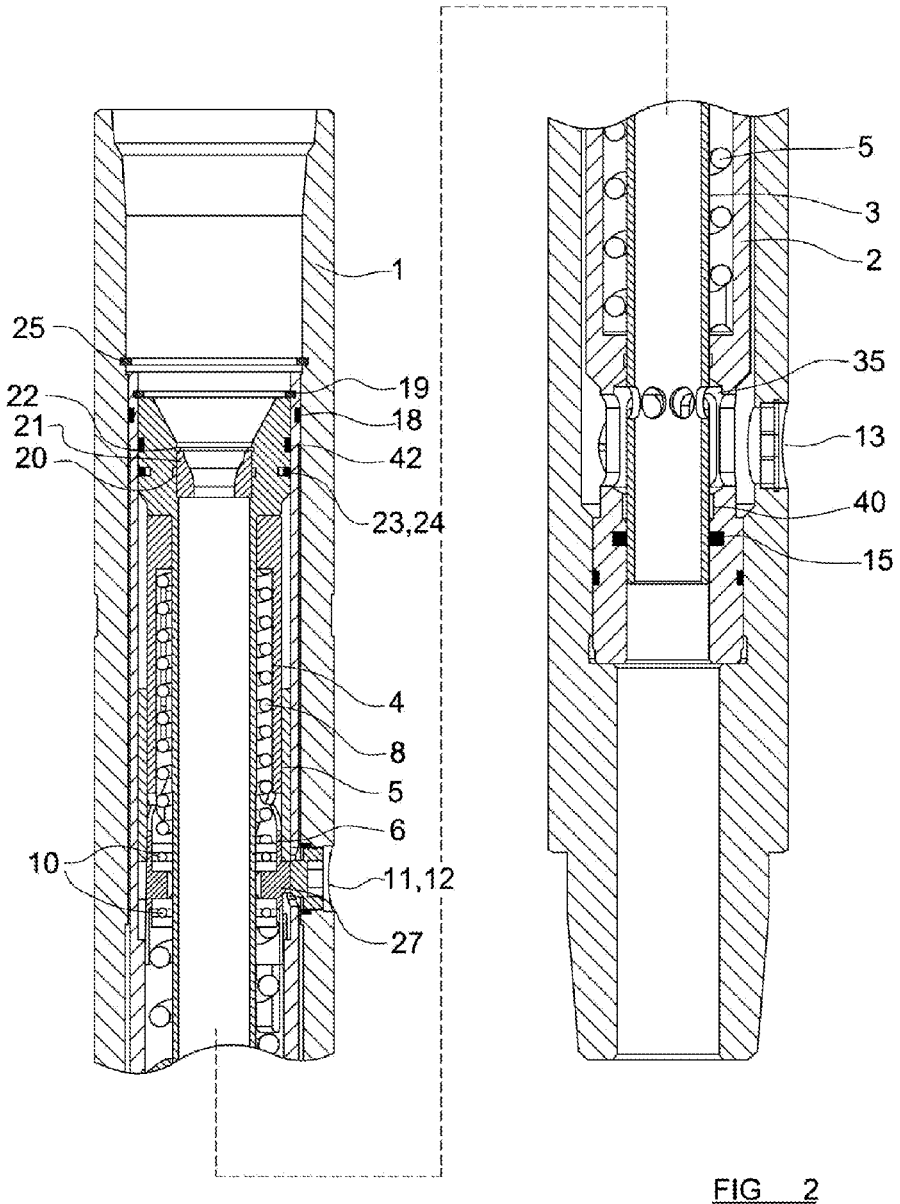
FIG. 2 is a close-up view of the bypass valve of FIG. 1, in which the figure is split into two columns for greater clarity.

Referring firstly to FIGS. 1 and 2, a bypass valve embodying the present invention is shown. In these figures the valve is shown oriented in a vertical bore and so reference will be made to "upper" and "lower" ends (based on the valve as shown in FIG. 1) for convenience. However, it should be understood that the valve may be used in any orientation. The valve comprises a housing 1, which is generally in the shape of an elongate, hollow tube. A lower end of the housing 1 is tapered, and has a threaded surface 41 presented on the outer surface thereof for connection to other components. Similarly, the open upper end of the housing has a tapered inner profile, and comprises a further threaded section 40 so that a further component may be fitted inside the housing 1.

Approximately halfway along its length, the housing 1 has a port 48 formed therethrough, the port 48 being approximately circular in shape.

Approximately, two-thirds of the way along the housing 1, closer to the lower end thereof, four outlets 37 are formed through the wall of the housing 1. Each of the outlets 37 is approximately circular in shape, and the outlets 37 are evenly spaced around the circumference of the housing 1. Preferably, a filter element 13 having a plurality of smaller apertures is fixed in each outlet 37 and is sealed in place with a seal 14, to prevent larger objects from passing through the outlets 37.

Contained within the housing 1 is an inner tubular member 2, which fits snugly within the hollow interior of the housing 1 and is coaxial therewith, with fluid-tight seals being provided at the upper and lower ends by respective circular seals 18, 17, received in grooves 56 formed on the outer surface of the inner tubular member 2. The lower end of the inner tubular member 2 rests on a shoulder 60 formed within the housing 1, and the upper end thereof is held in place by a retainer 25, which takes the form of a circlip which is slotted into a receiving groove formed in the inner surface of the housing 1. The inner tubular member 2 may therefore not move axially with respect to the outer housing 1.

Near the lower end of the inner tubular member 2, a series of apertures 57 are provided, which substantially align with the outlets 37 formed in the housing 1, and a wear ring 66 is provided a short distance above the apertures 57.

Figure 10A:
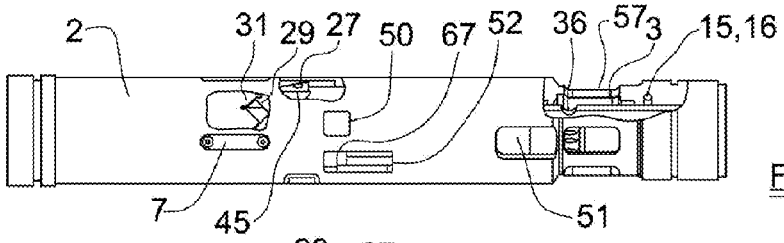
FIGS. 10*a* to 10*h* show a further sequence of events occurring during use of the bypass valve of FIG. 1.
Figure 10B:
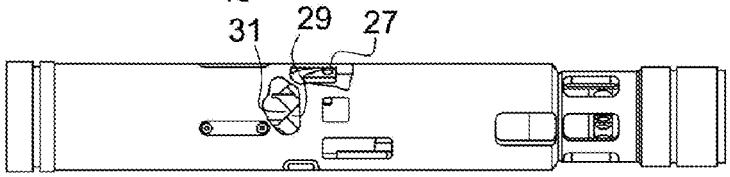
Figure 10C:
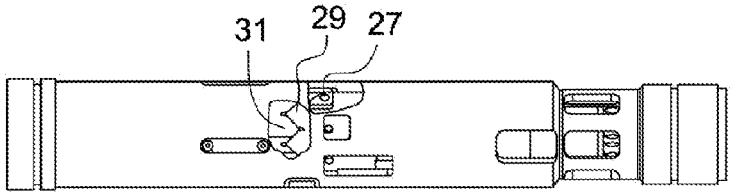
Figure 10D:
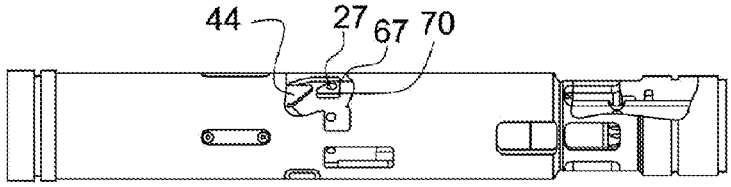
Figure 10E:
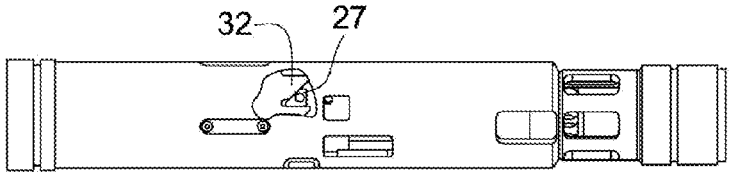

An upward-facing shoulder 67 (see FIGS. 10*a* and 10*d*) runs around the inner circumference of the inner tubular member 2, around halfway along the length thereof. First and second slots 50,52 are cut into the wall of the inner tubular member 2, each of these slots 50,52 being substantially parallel with the longitudinal axis of the inner tubular member 2, having aligned upper edges shortly above the upward-facing shoulder 67, and having lower edges which are each lower than the shoulder 67. The second slot 52 is longer than the first slot 50, having a lower edge which terminates lower down the inner tubular member 2.

The first and second control slots 50,52 are provided in spaced relation to one another, and are separated from one another by approximately 45° around the circumference of the inner tubular member 2.

The inner tubular member 2 further has a pair of elongate access apertures 49 formed through opposite sides thereof, around one-third of the way from the upper end. The purpose of the access apertures 49 will be described below.

Within the inner tubular member 2 is a hollow piston 3, which is slidably received within the inner tubular member 2 so that a gap having a substantially annular cross-section exists between the inner surface of the inner tubular member 2 and the outer surface of the piston 3. The piston 3 is prevented from leaving the inner tubular member 2 at its upper end by a retainer 19, but the space between the retainer 19 and the lower end of the piston 3 is larger than the piston 3, and therefore allows for sliding motion of the piston 3 within the inner tubular member 2. A circular seal 15, which is received in a groove 16 formed on the inner surface of the inner tubular member 2, surrounds the lower end of the piston 3 to create a substantially fluid-tight seal while still allowing axial sliding motion of the piston 3. A similar seal 23 is provided in a groove 24 to provide a seal at the upper end of the piston 3, and a wear ring 42 is also provided. The upper end 55 of the inner tubular member 2 is widened to provide a close fit against the inner surface of the inner tubular member 2.

Near the bottom end of the piston 3 a number of ports 36 are formed, which allow communication between the interior of the piston 3 and the exterior thereof. The piston 3 is slidable within the inner tubular member 2 between a first range of positions, in which the ports 36 at least partially aligned with the apertures of the inner tubular member 2 so the fluid may flow from the interior of the piston 3 through the ports 36, through the apertures 57 and out of the housing 1 through the outlets 37, and a second position, in which the ports 36 do not align with the outlets of the inner tubular member 2 (in the embodiments shown, by being displaced too far downwards), so that fluid within the interior of the piston 3 may not escape outwardly through the inner tubular member 2.

The upper end 38 of the piston 3 is provided with a recess into which a variable nozzle 21 can be inserted, the nozzle 21 being sealed with a seal 20 and retained in position with retainer 22. The nozzle 21 may be adjusted to vary the operating flow rate regime of the valve, subject to circulating fluid properties, such as density and system pressure limitation. System pressure limitation usually occurs as a function of operating depth and thus frictional losses or pressure drop across any other equipment within the system for any given circulating pump capacity. The operating pressure drop through the nozzle 21 will be cumulative to the total system circulating pressure.

The housing 1, inner tubular member 2 and piston 3 provide a continuous axial flow path through the valve through which fluid may flow.

Figure 6:
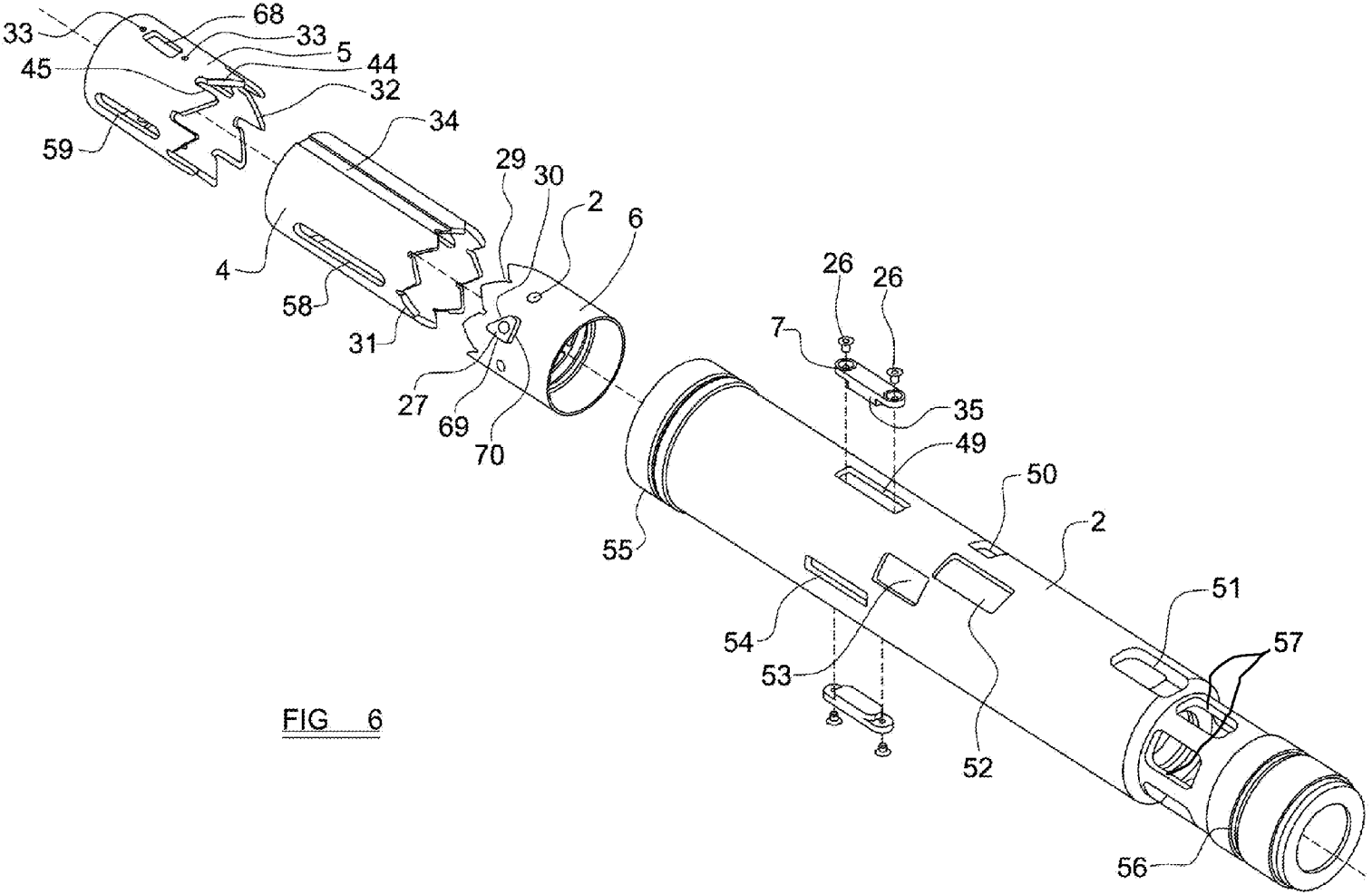
FIG. 6 is an exploded view of selected parts of the bypass valve of FIG. 1.
Figure 7A:
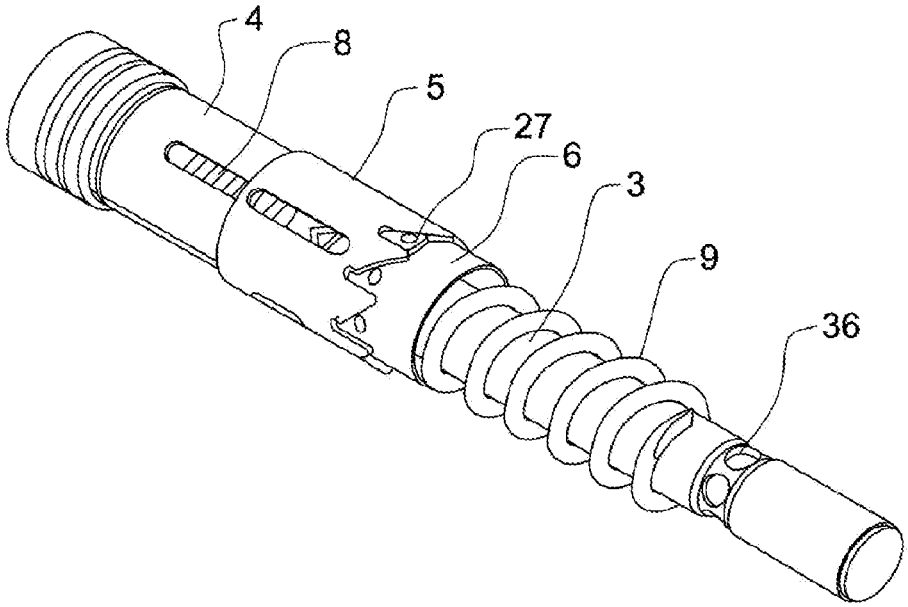
FIGS. 7*a*-7*b* are perspective views of selected components of the bypass valve of FIG. 1.
Figure 7B:
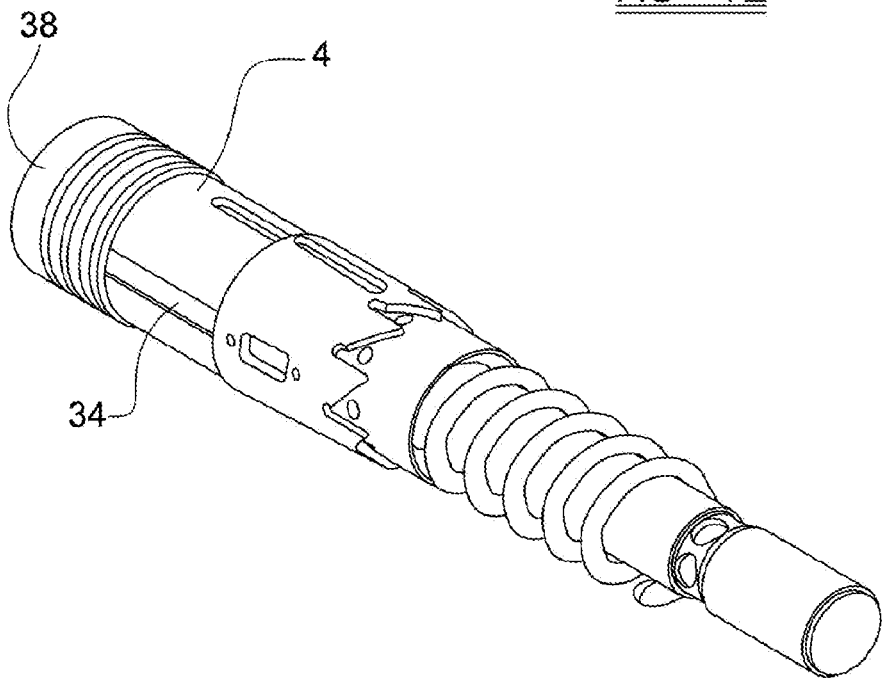

In the annular space between the inner tubular member 2 and the piston 3 a control arrangement is provided, the components of which are seen most clearly in FIG. 6.

The control arrangement comprises a driving member 4, which takes the form of a cylindrical collar having a flat upper end, which is fitted around the upper end of the piston 3, an upper edge 62 of the driving member 4 abutting against a downward-facing shoulder 63 provided near the upper end 38 of the piston 3. The lower end of the driving member 4 is formed into a saw-tooth profile having a number of symmetrical pointed teeth 31 formed by inclined planes, so that the profile of the lower end resembles a crown. Preferably, eight evenly-spaced teeth 31 are provided.

A control element 5 fits snugly around the driving member 4 but may slide axially with respect thereto, and also takes the form of a hollow cylinder having a flat upper end. A lower end of the control element 5 is formed into a series of asymmetric saw-tooth-shaped teeth 32, each of which has a straight edge 45, which is substantially parallel with the central axis of the cylindrical shape, and an inclined edge 44. Preferably, the control element 5 has eight such teeth 32.

Figure 4A:
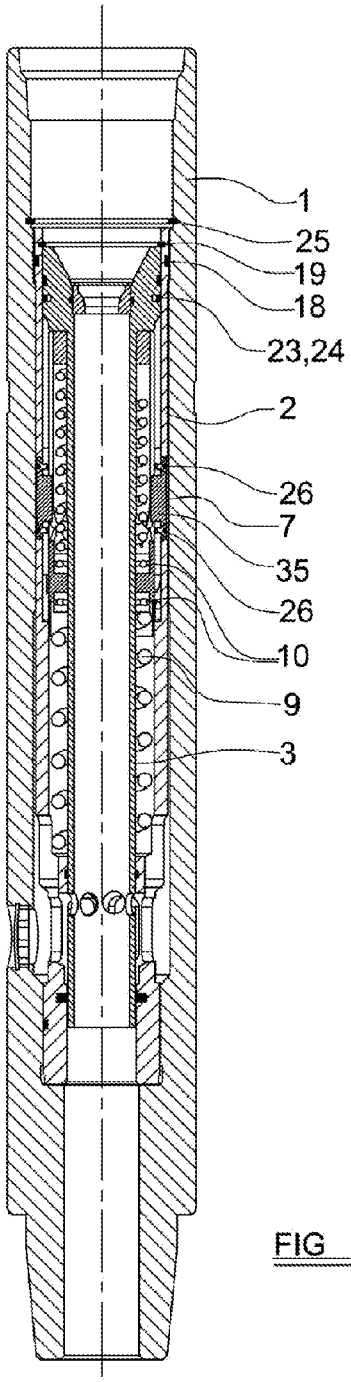
FIGS. 4*a*-4*b* are cut-away views of the bypass valve of FIG. 1, rotated through 90°.
Figure 4B:
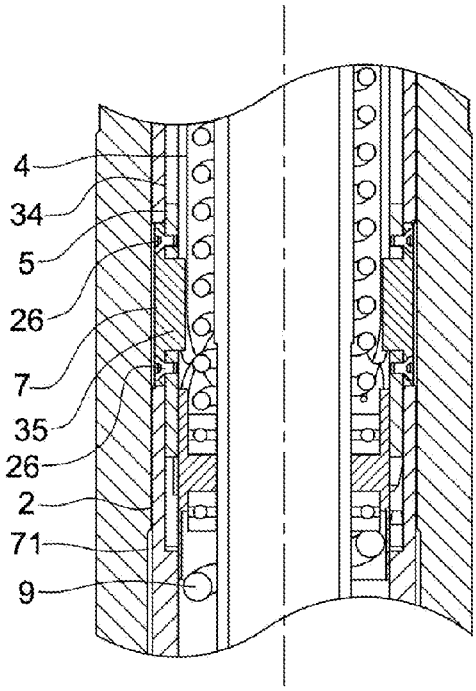
Figure 5:
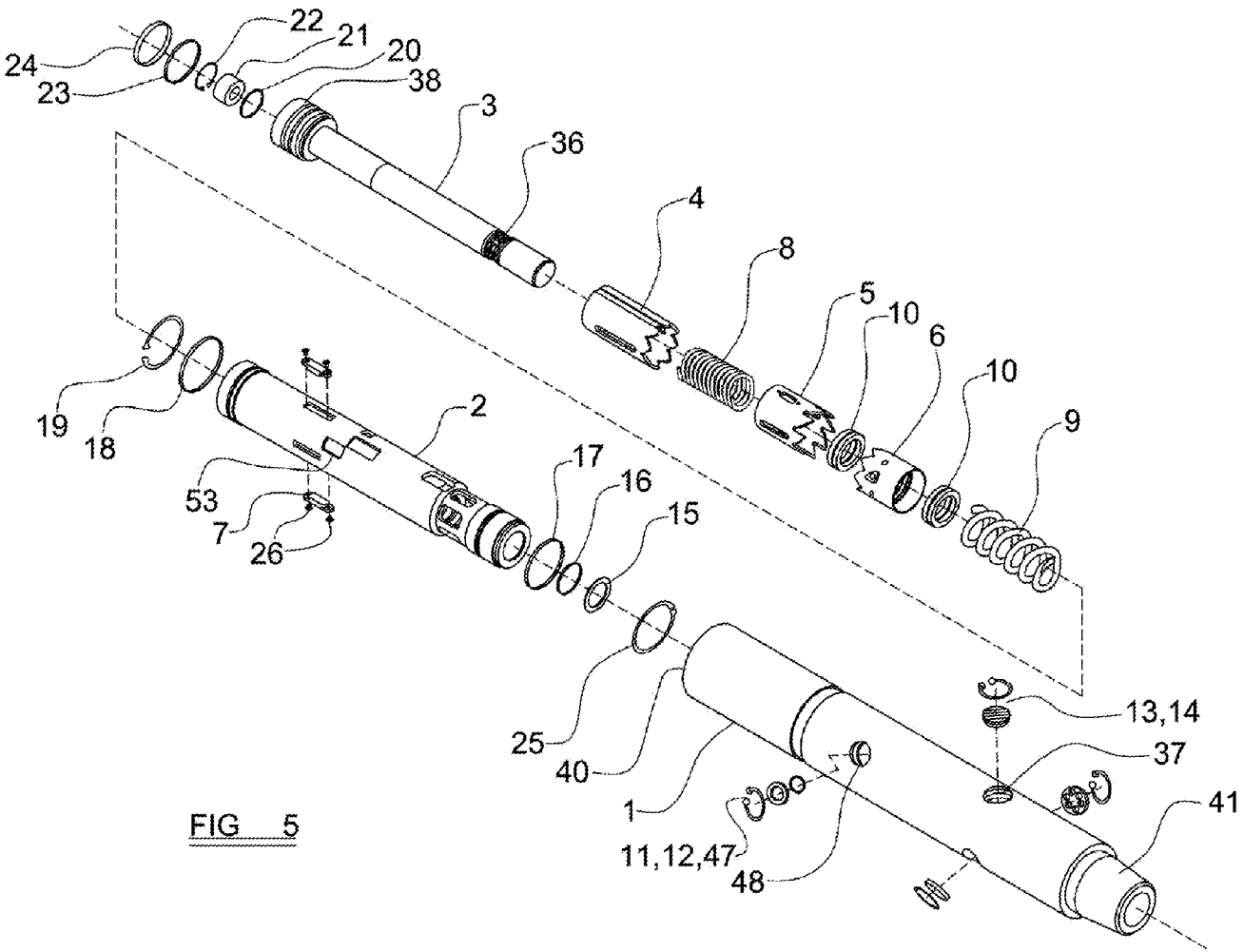
FIG. 5 is an exploded view showing the component parts of the bypass valve of FIG. 1.

The outer surface of the control element 5 fits against the inner surface of the inner tubular member 2, and is fixed thereto by means of two plugs 7, which pass through the control apertures 49 formed in the outer surface of the inner tubular member 2, and through registration holes 68 formed in the outer surface of the control element 5. The plugs 7 are each held in place by two screws 26, which are received in corresponding threaded holes 33 provided immediately above and below the registration holes 68. Noses 35 of the plugs 7 protrude through the registration holes 68 into the interior of the control element 5 and are received in respective elongate grooves 34 which are formed in an outer surface of the driving member 4 and are parallel with the longitudinal axis thereof. This arrangement can be seen in FIG. 4, in which the valve is rotated through 90° with respect to the valve shown in FIG. 1.

It will thus be appreciated that the driving member 4 may be driven slidably with respect to the control element 5, by movement of the piston 3 relative to the inner tubular member 2, but may not rotate with respect thereto due to the nose 35 of the plug 7 being received in the elongate slot 34.

The control arrangement also comprises a timing element 6, which again the form of a hollow cylinder. The timing element 6 has a flat bottom edge, but the top edge is formed into a saw-tooth shape which corresponds to the saw toothed configuration of the lower end of the driving member 4, having a number of symmetrically-shaped teeth 29 which may mesh with the teeth 31 of the driving member 4. The driving member 4 and the timing element 6 have substantially equal diameters and may mesh together completely, their teeth 29,31 interlocking with one another.

The timing element 6 has an inward-protruding ridge 64 disposed around the inner circumference thereof, the ridge 64 having upper and lower surfaces which are substantially perpendicular to the longitudinal axis of the timing element 6.

The timing element 6 has a key 27 disposed on an outer surface thereof, and fixed in place. The key 27 has a depth which is substantially equal to the thickness of the wall of the control element 5, and takes the form of a right-angled triangle, arranged such that a side edge 69 is substantially parallel with the longitudinal axis of the timing element 6, a bottom edge 70 is parallel with the flat lower edge of the timing element 6, and an inclined edge 30 is set at an angle with respect to these other two edges 69,70, with this angle matching that of the asymmetric teeth 44 of the control element 5. The key 27 may be integral with the timing element 6, or may be fixed securely to the outer surface of the timing element 6, for instance by one or more screws, by an adhesive, or by welding.

The timing element 6 is axially rotatable with respect to the piston 3 and the inner tubular member 2, having ring bearings 10 provided on the upper and lower surfaces of the inwardly-protruding ridge 64.

At the upper edge of the driving member 4 an inwardly-protruding lip 62 is provided, having a downward-facing shoulder 61. An upper spring 8 is provided in the space between the piston 3 and the driving member 4, and the spring is abutted at its upper end against the downward-facing shoulder 61 and at its lower end against the bearing 10 which is provided on the upper surface of the inward-protruding ridge 64 of the timing element 6. The upper spring 8 is a helical compression spring, which biases the timing element 6 downwardly with respect to the driving member 4.

A lower spring 9 is also provided in the space between the piston 3 and the inner tubular member 2, and abuts at its upper end against the bearing 10 provided on the lower surface of the inwardly-protruding ridge 64 of the timing element 6 and at its lower end against a shoulder 65 which is provided near the lower edge of the inner tubular member 2. The lower spring 9 is also a helical compression spring which biases the timing element 6 upwardly with respect to the inner tubular member 2.

It will therefore be appreciated that the timing element 6 is in a "floating" position both axially and rotationally between the outer surface of the piston 3 and the inner surface of the inner tubular member 2, and is biased into a "rest position" with respect to the other components.

In a start position, the key 27 is received snugly between first and second teeth 32 of the control element 5, with the inclined edge 70 of the key abutted against the inclined edge 44 of the first tooth 32 and the straight edge 69 of the key abutted against the straight edge 45 of the second tooth 32. This configuration is shown in FIG. 8*a*, which marks the start of a sequence of movement which will be disclosed below.

Figures 8A, 8B, 8C, 8D, 8E, 8F, 8G, 8H:
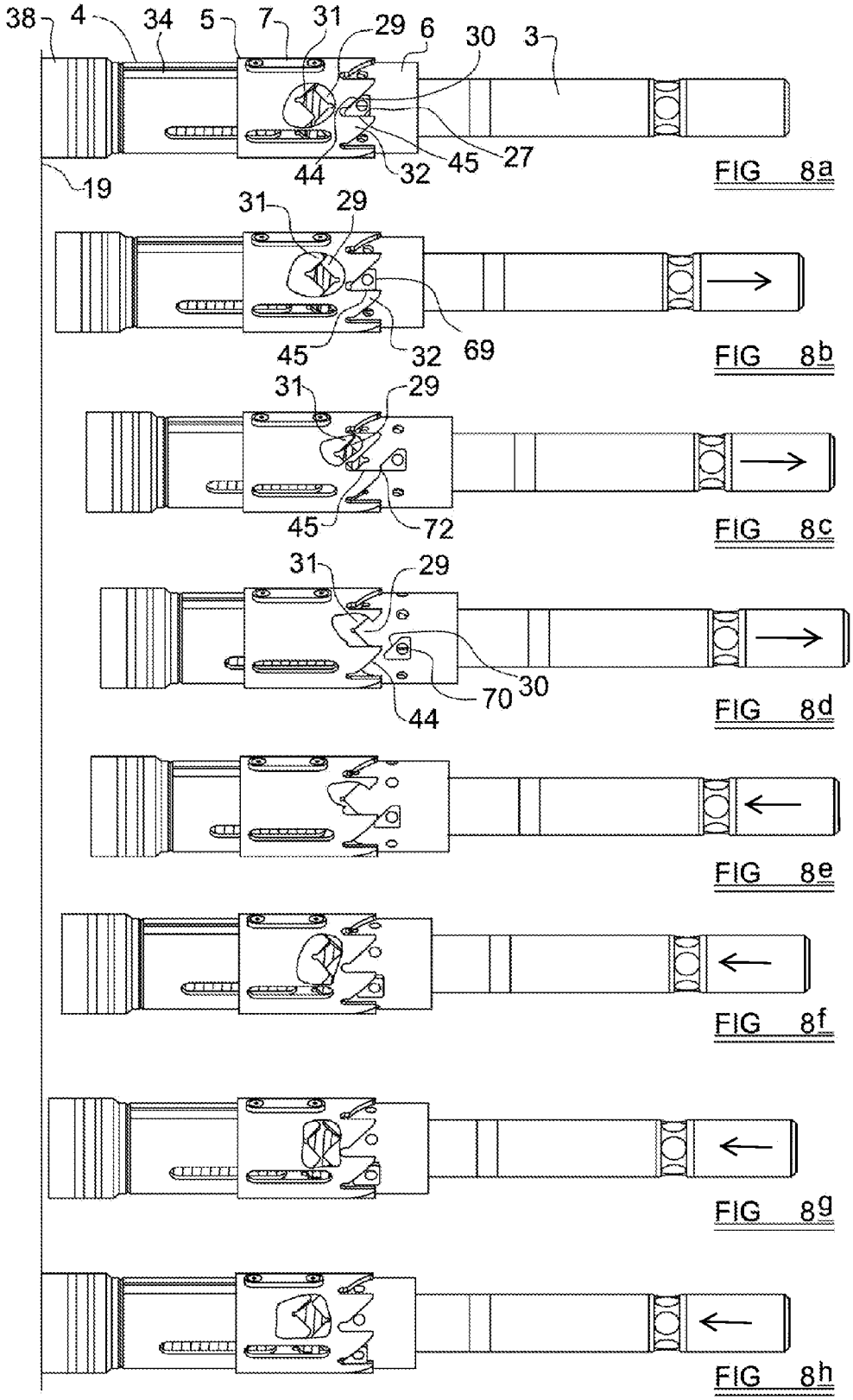
FIGS. 8*a* to 8*h* show a sequence of motion during use of the bypass valve of FIG. 1.
Figure 9A:
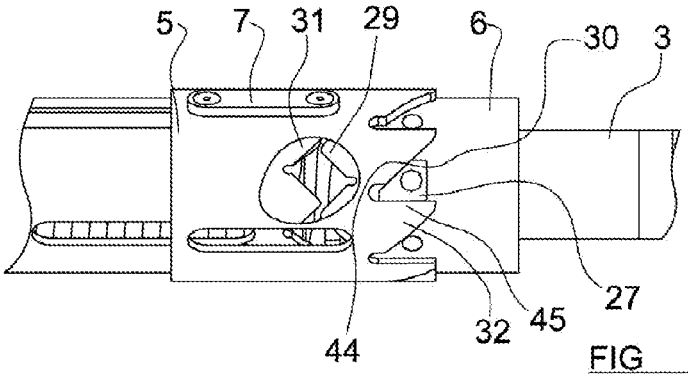
FIGS. 9*a* to 9*h* show more close-up versions of the sequences illustrated in FIGS. 8*a* to 8*h*.
Figure 9B:
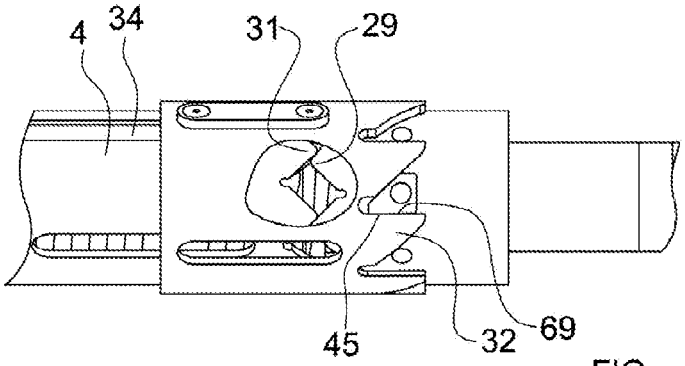
Figure 9C:
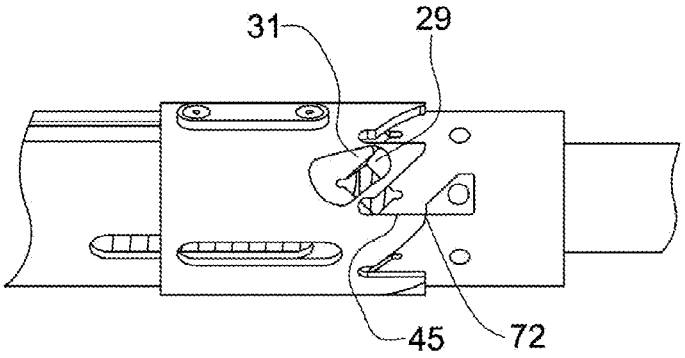
Figure 9D:
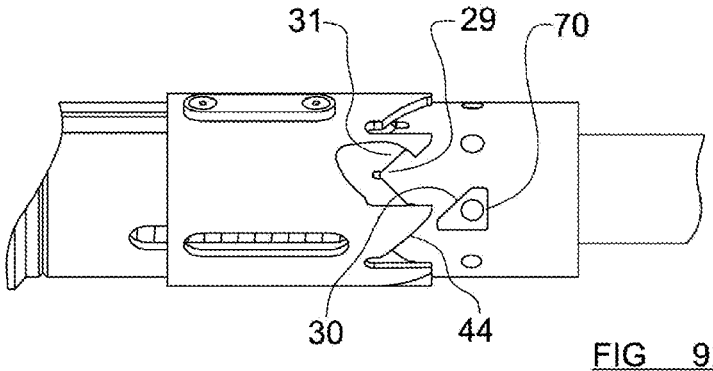
Figure 9E:
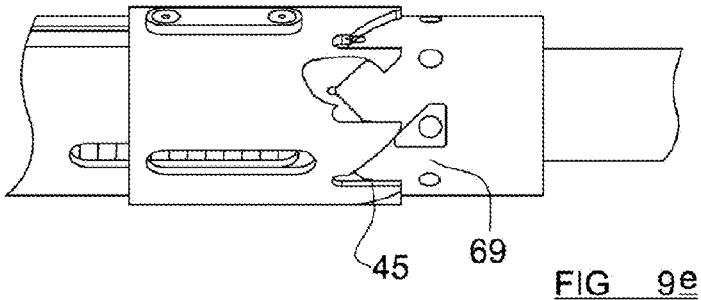
Figure 9F:
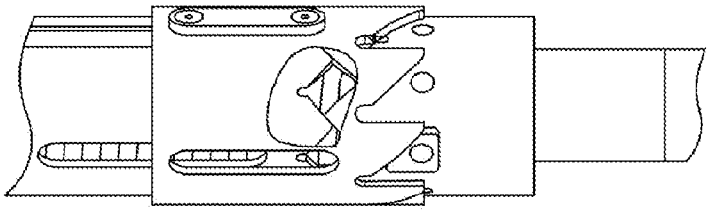
Figure 9G:
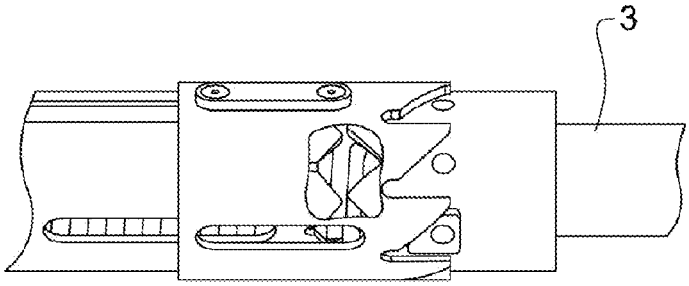
Figure 9H:
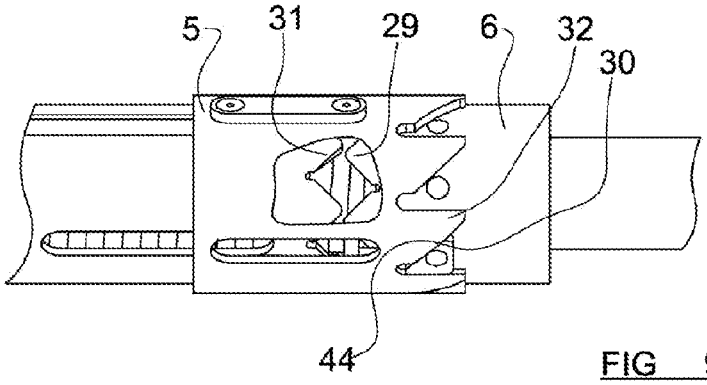

In the initial position shown in FIG. 8*a*, the saw-teeth 29 of the timing element 6 are spaced apart from the saw teeth 31 of the driving member 4, and the sets of teeth 29, 31 are also rotationally offset with respect to one another.

Referring to FIG. 8*b*, well fluid is circulated through the valve, and this causes the driving member 4 to be driven downwards (which corresponds to the right in FIGS. 8, 9 and 10), along with the main body of the piston 3 itself. The saw teeth 31 of the driving member 4 come into contact with the saw teeth 29 of the timing element 6, and push the timing element 6 downwards. The respective saw teeth 29,31 are misaligned, which exerts a rotational force on the timing element 6. At this stage, however, the timing element 6 may not rotate, since the straight edge 69 of the key 27 is abutted against the vertical edge 45 of the second of the saw teeth 44 of the control element 5, preventing this rotation.

As the driving member 4 is driven further downward, as shown in FIG. 8*c*, the timing element 6 is pushed further downwards, until the key 27 is pushed beyond the saw teeth 44 of the control element 5. At this point, the timing element 6 rotates with respect to the control element 5 and the driving member 4, due to the forces acting between the inclined edges of the saw teeth 29,32 of these two components. The timing element 6 rotates until the saw teeth 29,32 of the timing element 4 and the driving member 4 mesh completely together, as shown in FIG. 8*d*. Further downward motion of the driving member 4 and timing element 6 is prevented by the lower edge 70 of the key 27 contacting the upward-facing shoulder 67 which is formed in the inner surface of the inner tubular member 2.

As shown in FIG. 8*e*, when the circulation of well fluid ceases or drops sufficiently, the timing element 6 begins to travel in an upward direction, impelled by the lower spring 9 back towards its rest position. As can be seen in FIG. 8*e*, the key 27 has rotated with the timing element 6 so that the straight edge 69 of the key 27 has moved past the straight edge 45 of the second tooth 32 of the control element 5, and so as the timing element 6 travels upwards the inclined surface 30 of the key 27 now comes into contact with the inclined surface 44 of the second saw tooth 32 of the control element 5. It will be appreciated that, as the timing element 6 continues to move upwards, the timing element 6 will again rotate in the same direction as before, with respect to the control element 5, as the inclined surface 30 of the key 27 slides along the inclined surface 44 of the second saw tooth 32 This continues, as can be seen in FIGS. 8*f* and 8*g*, until the key 27 fits snugly between the inclined edge 44 of the second saw tooth 32 and straight edge 45 of the next saw tooth 32 along, as can be seen in FIG. 8*h*. As a result of the sequence of action shown in FIGS. 8*a* to 8*h*, the timing element 6 has rotated with respect to the piston, the inner tubular member 2 and housing 1 by one "notch", corresponding to a rotation of one-eighth of a full turn. It will be appreciated that, if the circulation of well fluid is initiated and subsequently ceased once again, the timing element 6 can be driven to rotate by another increment, and that this process can be repeated.

As discussed above, at the maximum downward point of movement of the timing element 6, the motion thereof is arrested by the bottom edge 70 of the key 27 contacting the upward-facing shoulder 67. The relative distances are arranged so that, during this motion which is arrested by the upward-facing shoulder 67, the piston 3 remains within the first range of positions with respect to the housing 1, so that the ports 36 of the piston 3 align at least partially with the apertures in the inner tubular member 2, thus allowing well fluid to flow from the interior of the piston 3 outwardly into the annulus.

However, in one rotational position of the timing element 6, the key 27 aligns with the first control slot 50 formed in the wall of the inner tubular member 2. In this position, the timing element 6 may slide downwardly, past the upward-facing shoulder 67, until motion thereof is arrested by the lower edge of the first control slot 50. At this point, the piston 3 is still within the first range positions with respect to the inner tubular member 2, but the ports 36 of the piston are partially occluded at the lower end of the motion of the piston 3, and this will have an impact on the pressure of the fluid circulating through the valve, which will be detectable at the surface.

When circulation through the valve ceases, and is subsequently increased again, the timing element 6 will rotate through one further "notch", and will align with the second control slot 52. In this motion, the piston 3 will be able to move downwardly until the lower edge 70 of the key 27 is arrested by the lower edge of the second control slot 52, allowing a longer downward stroke of the piston 3. At the first point of the motion of piston 3, the ports 36 thereof are entirely occluded, preventing fluid entering the valve from circulating to the annulus. At this point, fluid can be delivered through the valve under high pressure to components such a hydraulically-set packer, as discussed above.

Figure 10F:
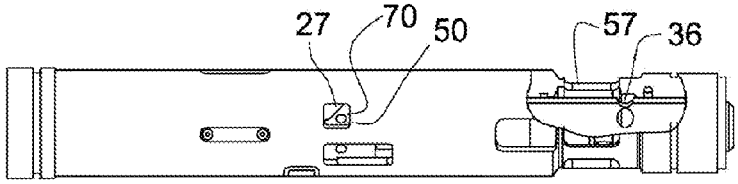
Figure 10G:
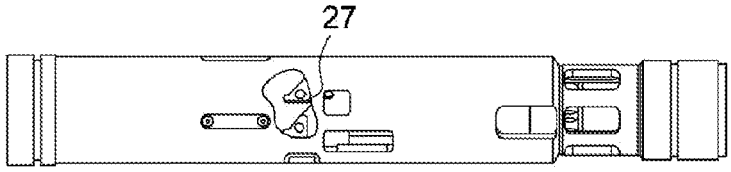
Figure 10H:
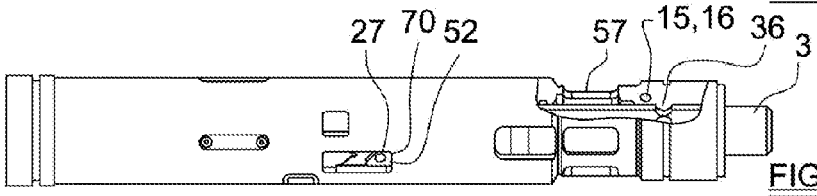

This sequence is shown in FIGS. 10*a* to 10*h*, in which, as can be seen in FIGS. 10*a* to 10*e*, the motion is kept within the first range of positions of the piston 3 by interaction of the key 27 and the upward-facing shoulder 67. However, as shown in FIG. 10*f*, the key 27 eventually aligns with the first slot 50, allowing a longer stroke in which the ports 36 of the piston 3 are partially occluded. As shown in FIG. 10*h*, the key 27 then aligns with the second slot 52, allowing an even longer stroke which places the piston 3 in the second position thereof relative to the inner tubular member 2.

The key 27 preferably has the numeral "1" prominently displayed thereon, and the numerals 2 through to 8 (indicated by reference numeral 28 in the figures) are also prominently displayed at evenly-spaced positions around the outer circumference of the timing element 6, on a level with the key 27.

Figure 3A:
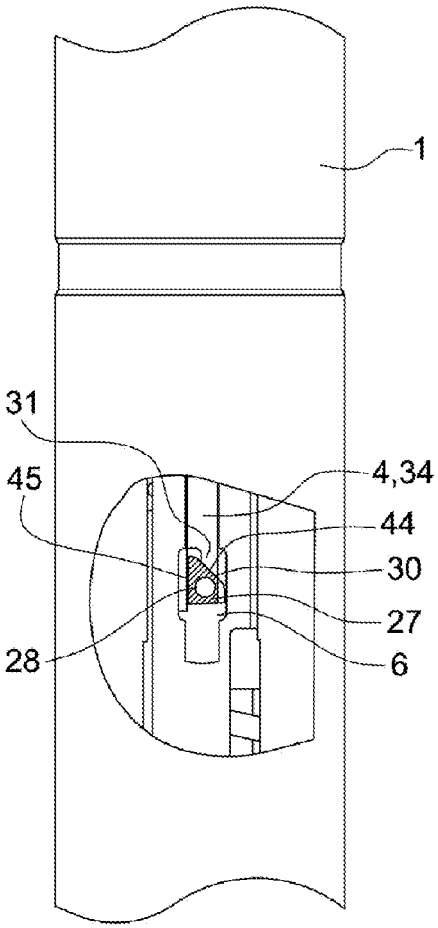
FIGS. 3*a*, 3*b* and 3*c* are close-up sections of parts of the bypass valve of FIG. 1.
Figure 3B:
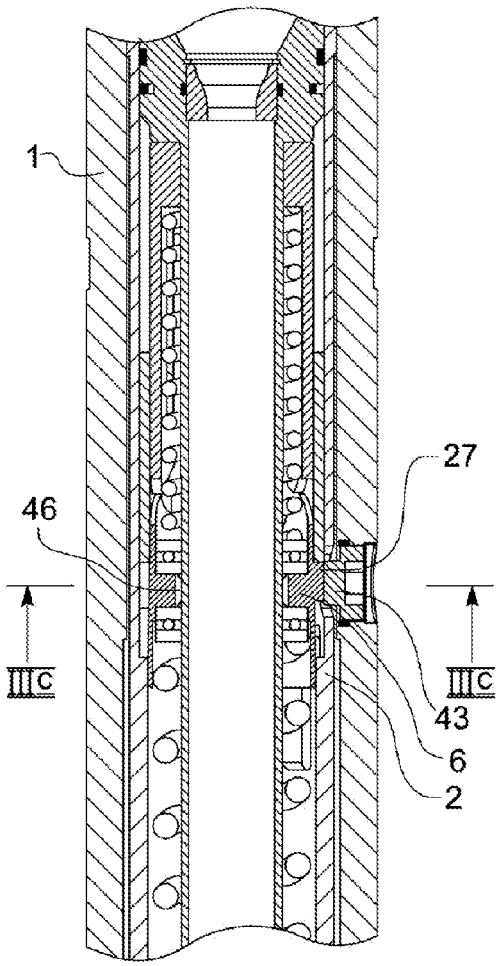
Figure 3C:
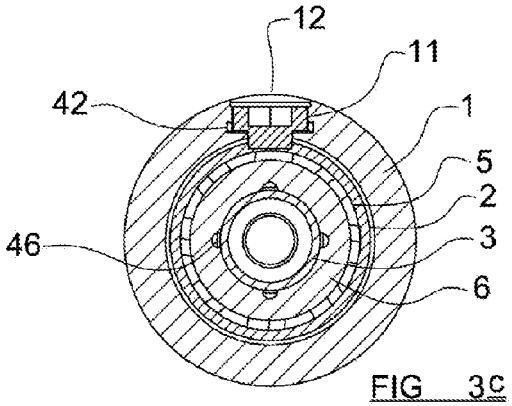

Preferably, as shown in FIGS. 3*a*, 3*b* and 3*c*, a plug 12 is provided in the port 48 in the housing 1, and this plug may be removed so that the exterior of the timing element 6 may be inspected. The arrangement is advantageously such that, when the key 27 with the reference numeral "1" displayed thereon can be seen (as shown in FIG. 3*a*), the key 1 is in a predetermined initial position. The plug 12 may then be inserted and sealed with a seal 11 and a retainer 47, so that a nose 43 thereof fits into the port 48, and the relative rotational orientation of the timing element 6 within the housing 1 is known. An operator then knows that after the circulation of the well fluid has been increased and subsequently decreased seven times, the timing element 6 will have rotated by seven "notches" and the key 27 will be aligned with the second control slot 52, so that the piston 3 may be driven into the second position with respect to the inner tubular member 2.

This is desirable because, as discussed above, it is advantageous to maintain the piston 3 in the first range of positions with respect to the inner tubular member 2 while certain operations are conducted, and then to move the piston 3 into the second position with respect to the inner tubular member 2, so that high pressure well fluid can be delivered to a hydraulic packer to set the packer before drilling or other operations commence.

A check is provided by the fact that, after six increases in well fluid circulation, the motion of the piston 3 will result in a detectable increase in the pressure of well fluid at the surface (as the key 27 aligns with the first control slot 50) and when this happens the operator knows that the timing element 6 is one "notch" from alignment with the second control slot 52.

Preferably, the piston 3 does not rotate with respect to the inner tubular member 2, or with respect to the housing 1. Only the timing element 6 rotates, and this is provided with bearings 10 as discussed above, to ease this rotation. Damage to the piston 3 or other components by rotational forces is therefore minimised or avoided.

It is preferred that further slots 51,53,54,59,58,46 are provided in the inner tubular member 2, the control element 5, the driving member 4 and the timing element 6, and these further slots are intended to provide for fluid displacement within the assembly, so that there can be no fluid cushion or lock as a result of a restricted area of the fluid displacement the operating sequence of the valve. The fluid displacement is into an annular chamber 71, which is located between the inner tubular member 2 and the housing 1.

The driving member 4, control element 5 and timing element 6 of the valve described and depicted in the figures each have eight teeth, although this need not be the case. In particular, the number of teeth may vary in dependence upon the size of the valve (a larger valve may require more teeth, and a smaller valve may require fewer) and on functional requirements, since more teeth will need to be provided if a particular job necessitates more rounds of increasing and decreasing well fluid circulation before the valve moves to its final position.

In further embodiments of the invention, the valve may be used to activate further components by physically contacting them, directly, or indirectly, rather than by supplying fluid at a particular pressure. In such embodiments, when the piston performs a relatively long stroke, a lower end of the piston (or a further component which is driven by the motion of the piston) may come into contact with a further component to activate or influence the further component.

For example, a drill string could include a drilling head adapted to drill an initial bore having a relatively low diameter (e.g. 8½ inches), and this could be followed by an under reamer adapted to enlarge to the initial bore to a greater diameter (for instance 12¼ inches), with the valve being located above the under reamer. In a first configuration, the under reamer is not activated, and only the drilling head is operational. However, when it is desired to activate the under reamer, the valve is manipulated as described above to cause the piston to perform a long stroke, and a lower end of the piston comes into contact with, and activates, the under reamer. This could be achieved, for example, by the piston depressing a piston within the under reamer, or by pushing against a sleeve which cuts through one or more shear pins, although a skilled person will appreciate that other methods are also possible.

In these embodiments, the circulation of fluid to the annulus is not essential, and so the ports in the piston may be absent. However, it is preferred that the ports are retained, as the ability to circulate fluid to the annulus is useful in many circumstances. In the case of the embodiment described above, the valve may initially be in the "closed" configuration, so that fluid may not circulate from the valve to the annulus and is delivered to the drilling head. However, once the under reamer has been activated, it is desirable for fluid to be delivered both to the drilling head and to the annulus, to aid in removal of waste matter, and so the valve may be configured such that ports in the piston are aligned with outlets in the housing at the furthest point of the long stroke. Since the diameter of the annulus between the drilling head and the under reamer will be less than that above the under reamer, a greater quantity of fluid may be circulated from the valve than through the drilling head (for instance, in a ratio of 60:40, although this ratio will be determined by the ratio of the flow area of drilling head to the flow area of the circulating ports).

In the embodiments discussed above, the reciprocal movement is used to operate a valve which is normally in an "open" position into a closed position, which may be reset to the open position by decreasing the pressure in the well fluid. Alternatively, however, the valve may normally be open and may be moved into the closed position as discussed above, such that it remains in the closed position once the pressure in the well fluid drops. The valve may also, be in a "closed" default position, and may be moved to the open position by reciprocal motion as discussed above.

It will be appreciated that, in certain embodiments of the invention, the inner tubular member may be absent, and that internal features of the inner tubular member may instead be formed directly onto the inner surface of the housing.

It will be appreciated that embodiments of the present invention provide a valve which will find utility in many applications.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A valve comprising:

a housing having an outer wall with at least one outlet formed therethrough;

a piston disposed within the outer wall and drivable with respect to the housing in a first direction, the piston having a fluid channel formed in an interior thereof; and a control arrangement comprising:

a rotating element which is rotatable with respect to the housing and the piston and is spring-biased in a second direction that is opposite the first direction, and a driving member which is adapted to drive against the rotating element, the control arrangement being such that:

in a first rotational orientation of the rotating element, the piston may be driven with respect to the housing in the first direction so that the driving member moves with respect to the rotating element and contacts the rotating element to exert a driving force against the rotating element which tends to drive the rotating element away from a rest position of the rotating element in a direction substantially parallel with the first direction, and relative motion between the piston and the housing is halted by the rotating element contacting a first stop element, during which motion the piston remains in a first position or range of positions relative to the housing; and in a second rotational orientation of the rotating element, the piston may be driven with respect to the housing in the first direction so that the piston reaches a second position relative to the housing where relative motion between the piston and the housing is halted by the rotating element contacting a second stop element, wherein the spring bias of the rotating element returns the rotating element toward the rest position once the driving force is removed.

2. The valve according to claim 1, wherein the piston has at least one port allowing communication between the fluid channel and an exterior of the piston, so that in the first position or range of positions of the piston relative to the housing the at least one port is in communication with the at least one outlet of the outer wall thereby allowing fluid to flow from the fluid channel through the at least one outlet, and such that in the second position of the piston relative to the housing the at least one port is not in communication with the at least one outlet of the outer wall and fluid is prevented from flowing from the fluid channel through the at least one outlet.

3. The valve according to claim 1, wherein the piston has at least one port allowing communication between the fluid channel and an exterior of the piston, the piston being movable to allow the first position or range of positions of the piston relative to the housing, in which at least one port is not in communication with the at least one outlet of the outer wall and fluid is prevented from flowing from the fluid channel through the at least one outlet, and the second position of the piston relative to the housing, in which the at least one port is in communication with the at least one outlet of the outer wall, allowing fluid to flow from the fluid channel through the at least one outlet.

4. The valve according to claim 1 wherein, in the first position or range of positions of the piston relative to the housing, the piston is spaced a first distance from a start position of the piston, and in the second position of the piston relative to the housing, the piston is spaced from the start position by a second distance that is greater than the first distance.

5. The valve according to claim 1, wherein the driving member and rotating element are provided with respective inclined engaging surfaces, so that the driving element exerts a rotational force on the rotating element when the driving member exerts a force against the rotating element which tends to drive the rotating element in a direction substantially parallel with the first direction.

6. The valve according to claim 1, wherein the rotating element has a key protruding from a surface thereof, which contacts the stop element when the rotating element is in the first rotational orientation thereof.

7. The valve according to claim 6, further comprising a control element having a number of recesses, each of the recesses being shaped to receive the key, a plurality of respective rotational orientations of the rotating element being defined by the key being received in each of the recesses.

8. The valve according to claim 7, wherein the control element does not rotate with respect to the piston.

9. The valve according to claim 6, wherein the stop element is formed on an inner surface of the housing, or on an inner member which at least partially surrounds the piston, the arrangement being such that, when the rotating element is in the first rotational orientation thereof, the key is aligned with the stop element, and when the rotating element is in the second rotational orientation thereof, the key is not aligned with the stop element.

10. The valve according to claim 9, wherein the stop element comprises a surface provided on the housing or the inner member, a control slot being formed which provides a break in the surface, so that when the rotating element is in the second rotational orientation thereof, the key is aligned with the control slot.

11. The valve according to claim 10, wherein the piston has at least one port allowing communication between the fluid channel and an exterior of the piston and wherein a further control slot is formed providing a break in the surface forming the stop element such that when the rotating element is aligned with the further control slot, the piston may be driven into a partial flow position which is within the first range of positions but in which the at least one port of the piston is partially occluded.

12. The valve according to claim 11 wherein, when the piston is in the partial flow position and the piston ceases being driven with respect to the housing, the rotating element moves into the second rotational orientation thereof.

13. The valve according to claim 1, comprising a viewing aperture in the housing which may be opened so that a current rotational orientation of the rotating element may be viewed.

14. The valve according to claim 1, wherein the piston may be driven by an increase in the flow rate of fluid passing through the valve.

15. The valve according to claim 1 wherein, when the rotating element is in the first rotational orientation thereof and the piston is driven relative to the housing, the rotating element moves to a different rotational orientation.

16. The valve according to claim 1 wherein, when the rotating element is in the first rotational orientation thereof, the piston may be driven relative to the housing so that the rotating element moves to the second rotational position thereof.

17. A valve comprising, a housing having an outer wall with at least one outlet formed therethrough;

a piston disposed within the outer wall, the piston having a fluid channel formed in an interior thereof; and a control arrangement comprising a rotating element which is rotatable with respect to the housing and the piston, and a driving member which is adapted to drive against the rotating element, the arrangement being such that:

in a first rotational orientation of the rotating element, the piston may be driven with respect to the housing in a first direction so that the driving member moves with respect to the rotating element and contacts the rotating element to exert a force against the rotating element which tends to drive the rotating element in a direction substantially parallel with the first direction, and relative motion between the piston and the housing is halted by the rotating element contacting a first stop element, during which motion the piston remains in a first position or range of positions relative to the housing; and in a second rotational orientation of the rotating element, the piston may be driven with respect to the housing in the first direction so that the piston reaches a second position relative to the housing where relative motion between the piston and the housing is halted by the rotating element contacting a second stop element; and wherein at least one of the rotating element and the driving member is axially slidable with respect to the piston.

18. A method of providing pressurised fluid to a component, comprising the steps of:

providing a valve according to claim 1;

positioning the component downstream of the valve, so that a fluid may flow through the valve and then to the component when the piston is in the second position relative to the housing;

placing the rotating element of the valve in the first rotational orientation thereof;

allowing fluid to flow through the valve;

increasing the rate of flow of the fluid so that the rotating element moves to the second rotational position; and increasing the rate of flow of the fluid so that the piston moves to the second position relative to the housing.

19. The method according to claim 18, wherein the component is a hydraulically-set packer.

20. A method of controlling a bypass valve for operating a component, comprising the steps of:

providing a valve according to claim 1;

placing the rotating element of the valve in the first rotational orientation thereof;

allowing fluid from upstream of the valve to flow through or to the valve;

increasing the rate of flow or quantity of the fluid to the valve so that the rotating element moves to the second rotational position; and increasing the rate of flow or quantity of the fluid to the valve so that the piston moves to the second position relative to the housing, thereby to enable the piston, or another element driven by the piston to contact a component that may be positioned downstream of the valve.

* * * * *